US009642450B1

(12) United States Patent
Singh et al.

(10) Patent No.: US 9,642,450 B1
(45) Date of Patent: May 9, 2017

(54) TOOTHBRUSH AND TONGUE CLEANER

(71) Applicants: Balwan Singh, Bellerose, NY (US); Ooshah Bharat, Bellerose, NY (US)

(72) Inventors: Balwan Singh, Bellerose, NY (US); Ooshah Bharat, Bellerose, NY (US)

( * ) Notice: Subject to any disclaimer, the term of this patent is extended or adjusted under 35 U.S.C. 154(b) by 0 days.

(21) Appl. No.: 15/145,101

(22) Filed: May 3, 2016

(51) Int. Cl.
*A46B 9/04* (2006.01)
*A46B 15/00* (2006.01)
*A46B 5/00* (2006.01)

(52) U.S. Cl.
CPC ..... *A46B 15/0081* (2013.01); *A46B 5/0016* (2013.01); *A46B 9/04* (2013.01)

(58) Field of Classification Search
CPC ..... A46B 5/0016; A46B 9/04; A46B 15/0081
See application file for complete search history.

(56) References Cited

U.S. PATENT DOCUMENTS

| | | | | |
|---|---|---|---|---|
| 4,455,704 | A | 6/1984 | Williams | |
| D295,695 | S | 5/1988 | Golzari | |
| 5,934,762 | A * | 8/1999 | Vrignaud | A46B 5/0012 15/106 |
| 5,980,541 | A * | 11/1999 | Tenzer | A46B 15/0055 15/111 |
| 6,273,719 | B1 * | 8/2001 | Whitman | A46B 15/0081 15/167.1 |
| D528,207 | S * | 9/2006 | Kling | D24/146 |
| D651,808 | S * | 1/2012 | Nguyen | D4/108 |
| D723,285 | S * | 3/2015 | Song | D4/108 |
| D727,626 | S * | 4/2015 | Bontemp | D4/105 |
| 2009/0235474 | A1 | 9/2009 | Seigel | |

* cited by examiner

*Primary Examiner* — Randall Chin
(74) *Attorney, Agent, or Firm* — Kyle A. Fletcher, Esq.

(57) ABSTRACT

The toothbrush and tongue cleaner is a device adapted for use in oral hygiene. The toothbrush and tongue cleaner is a combination toothbrush and tongue cleaning device mounted on a single handle. The toothbrush and tongue cleaner comprises a handle, a toothbrush, and a tongue cleaning device.

9 Claims, 3 Drawing Sheets

TOOTHBRUSH AND TONGUE CLEANER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities and brushware, more specifically, a brush combined with an accessory normally separate from the bushing process.

SUMMARY OF INVENTION

The toothbrush and tongue cleaner is a device adapted for use in oral hygiene. The toothbrush and tongue cleaner is a combination toothbrush and tongue cleaning device mounted on a single handle.

These together with additional objects, features and advantages of the toothbrush and tongue cleaner will be readily apparent to those of ordinary skill in the art upon reading the following detailed description of the presently preferred, but nonetheless illustrative, embodiments when taken in conjunction with the accompanying drawings.

In this respect, before explaining the current embodiments of the toothbrush and tongue cleaner in detail, it is to be understood that the toothbrush and tongue cleaner is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toothbrush and tongue cleaner.

It is therefore important that the claims be regarded as including such equivalent construction insofar as they do not depart from the spirit and scope of the toothbrush and tongue cleaner. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
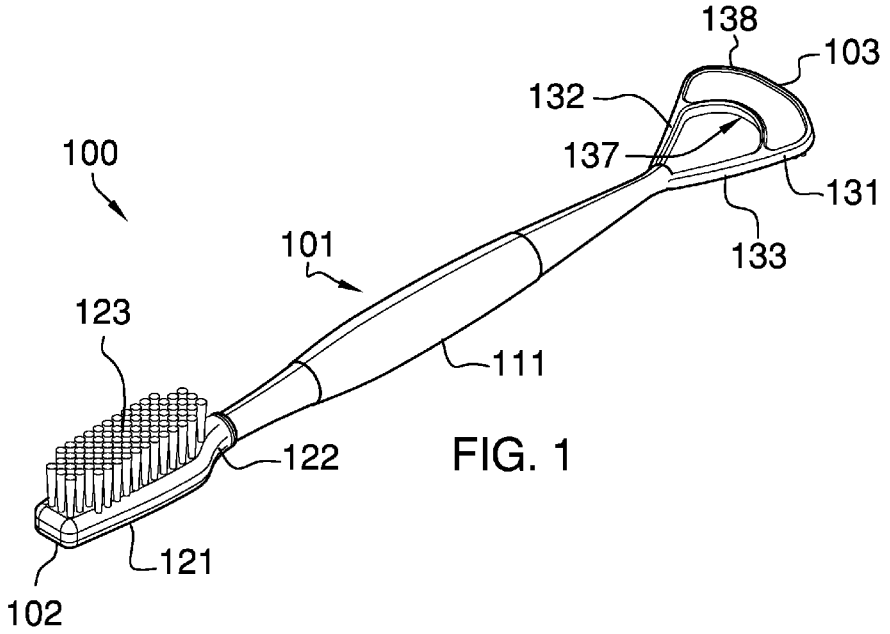
FIG. 1 is a top perspective view of an embodiment of the disclosure.
Figure 2:
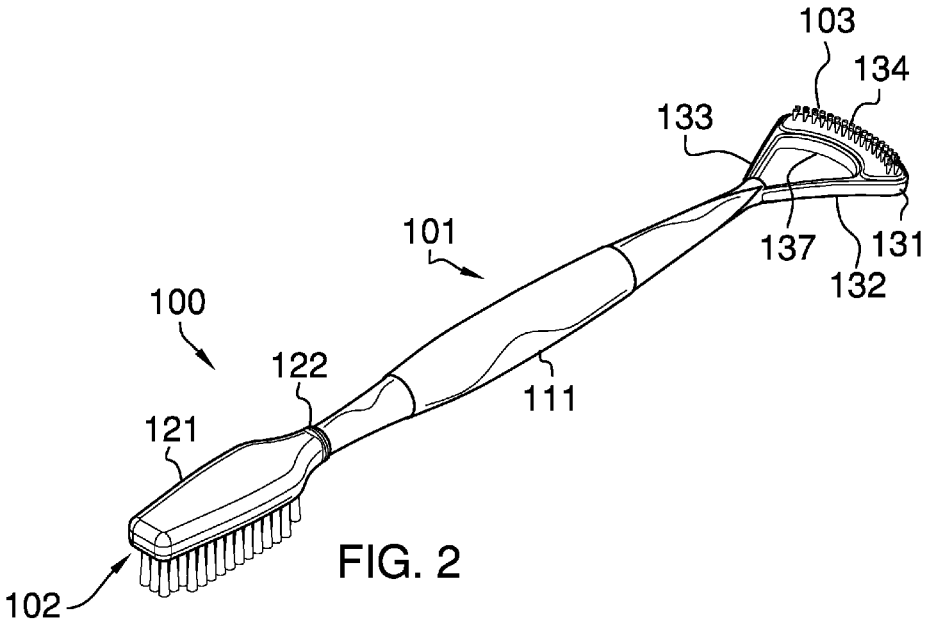
FIG. 2 is a bottom perspective view of an embodiment of the disclosure.
Figure 3:
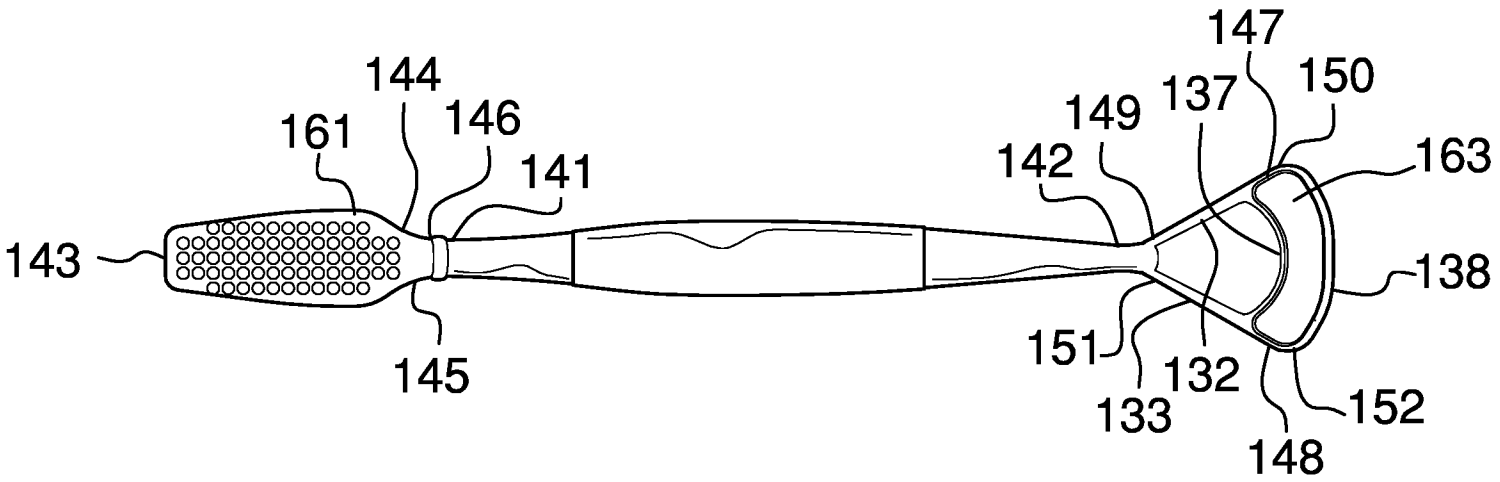
FIG. 3 is a top view of an embodiment of the disclosure.
Figure 4:
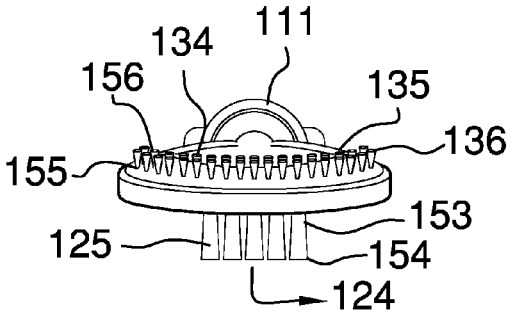
FIG. 4 is a side view of an embodiment of the disclosure.
Figure 5:
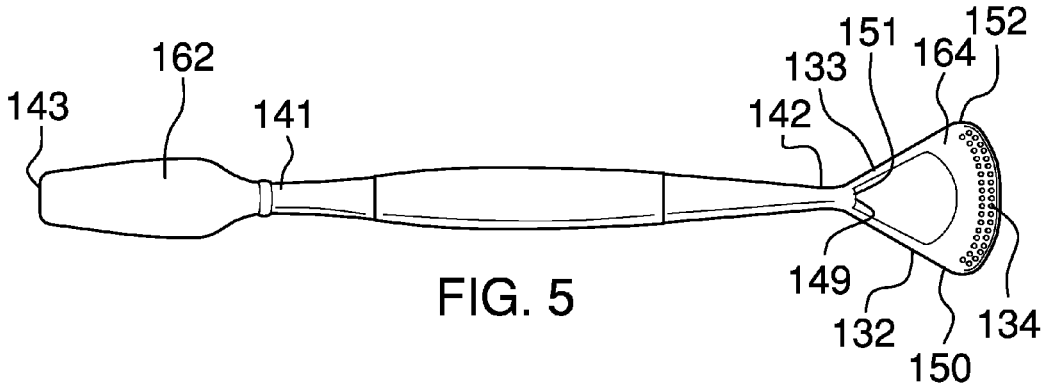
FIG. 5 is a bottom view of an embodiment of the disclosure.

Detailed reference will now be made to a first potential embodiment of the disclosure, which is illustrated in FIGS. 1 through 5.

The toothbrush and tongue cleaner 100 (hereinafter invention) comprises a handle 101, a toothbrush 102, and a tongue cleaning device 103. The invention 100 is a device adapted for use in oral hygiene. The invention 100 is a combination of the toothbrush 102 and the tongue cleaning device 103 mounted on the handle 101.

The handle 101 comprises a tapered shaft 111 that is further defined with a first end 141 and a second end 142. The handle 101 is a shaft like structure that is shaped in the form of the frustum of an ellipsoid that is further formed by a first plane and a second plane. Both the first plane and the second plane are perpendicular to the center axis of the ellipsoid. The center axis of the ellipsoid is aligned with major axis of the ellipsoid. The planar section formed by the first plane and the ellipsoid forms the first end 141. The planar section formed by the second plane and the ellipsoid forms the second end 142.

The toothbrush 102 comprises a first head 121, a first shank 122, a first plurality of bristles 123, a first brush surface 124, and a first plurality of bristle tips 125. The first head 121 is further defined with a third end 143, a fourth end 144, a first surface 161 and a second surface 162. The first shank 122 is further defined with a fifth end 145 and a sixth end 146. The first head 121 is an irregularly shaped plate structure.

The first plurality of bristles 123 is a first collection of individual bristles. Each of the first plurality of bristles 123 is further defined with a thirteenth end 153 and a fourteenth end 154. The thirteenth end 153 of each of the first plurality of bristles 123 is attached to the first surface 161 of the first head 121 such that each of the first plurality of bristles 123 projects away from the first surface 161 like a cantilever. Taken together, the fourteenth end 154 of each of the first plurality of bristles 123 forms a first plurality of bristle tips 125. The length of the span of each of the first plurality of bristles 123 is selected such that the first plurality of bristle tips 125 forms a first brush surface 124. The first brush surface 124 provides a scrubbing surface that is used to clean teeth for oral hygiene purposes. Based on the design of the toothbrush 102, the first brush surface 124 may be a planar surface or a non-planar surface.

The first shank 122 is a structure that joins the fourth end 144 of the first head 121 to the first end 141 of the handle 101. The first shank 122 is a transition structure. The sixth end 146 of the first shank 122 is formed with an elliptical or circular structure that corresponds to the elliptical or circular structure of the first end 141 of the handle 101. The sixth end 146 of the first shank 122 is attached to the first end 141 of the handle 101. The fifth end 145 of the first shank 122 is formed in a rectangular shape that corresponds to the rectangular structure of the irregular plate that forms the first head 121. The fifth end 145 of the first shank 122 is attached to the fourth end 144 of the first head 121. The structure of the first shank 122 between the fifth end 145 and the sixth end 146 forms a smooth and continuous surface that transitions between the shape of the fifth end 145 and the shape of the sixth end 146.

The tongue cleaning device 103 further comprises a second head 131, a first arm 132, a second arm 133, a second plurality of bristles 134, a second brush surface 135, and a second plurality of bristle tips 136. The second head 131 is further defined with a seventh end 147, an eighth end 148, a third surface 163, a fourth surface 164, an inner arc 137, and an outer arc 138. The first arm 132 is further defined by a ninth end 149 and a tenth end 150. The second arm 133 is further defined by an eleventh end 151 and a twelfth end 152. The first surface 161 and the third surface 163 share the same plane. The second surface 162 and the fourth surface 164 share the same plane.

The second head 131 is a plate structure. The perimeter of the third surface 163 and the fourth surface 164 are both bounded by the seventh end 147, the eighth end 148, the inner arc 137, and the outer arc 138. The inner arc 137 is formed as a segment of the circumference of a first circle or ellipse. The outer arc 138 is formed as a segment of the circumference of a second circle or ellipse. The second circle or ellipse has the same center point or points as the first circle or ellipse. The second head 131 is attached to the second end 142 of the handle 101 using the first arm 132 and the second arm 133. The first arm 132 is a cylindrical structure. The second arm 133 is a cylindrical structure. The ninth end 149 of the first arm 132 attaches to the second end 142 of the handle 101. The eleventh end 151 of the second arm 133 attaches to the second end 142 of the handle 101. As shown most clearly in FIG. 1, the tenth end 150 of the first arm 132 forms the seventh end 147 of the second head 131 and the twelfth end 152 of the second arm 133 forms the eighth end 148 of the second head 131.

The second plurality of bristles 134 is a second collection of individual bristles. Each of the second plurality of bristles 134 is further defined with a fifteenth end 155 and a sixteenth end 156. The fifteenth end 155 of each of the second plurality of bristles 134 is attached to the fourth surface 164 of the second head 131 such that each of the second plurality of bristles 134 projects away from the fourth surface 164 like a cantilever. Taken together, the sixteenth end 156 of each of the second plurality of bristles 134 forms a second plurality of bristle tips 136. The length of the span of each of the second plurality of bristles 134 is selected such that the second plurality of bristle tips 136 forms a second brush surface 135. The second brush surface 135 is a planar scrubbing surface that is used to clean the tongue for oral hygiene purposes.

The toothbrush 102 is used as a normal manual toothbrush. To use the tongue cleaning device 103, the handle 101 is rotated 180 degrees from the toothbrush 102 position and the second brush surface 135 is rubbed against the surface of the tongue.

With the exception of the first plurality of bristles 123 and the second plurality of bristles 134, the invention 100 is formed from molded plastic as a single unit. The first plurality of bristles 123 and the second plurality of bristles 134 are added separately. Methods to add bristles structures to form brushes are well known in the art.

The following definitions were used in this disclosure:

Bristle: As used in this disclosure, a bristle is a short course and stiff hair like object.

Cantilever: As used in this disclosure, a cantilever is a beam or other structure that projects away from an object and is supported on only one end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Correspond: As used in this disclosure, the term correspond is used as a comparison between two or more objects wherein one or more properties shared by the two or more objects match, agree, or align within acceptable manufacturing tolerances.

Ellipsoid: As used in this disclosure, an ellipsoid is a three dimensional geometric surface through which all planar surfaces form either circles or ellipses. An ellipsoid is a type of quadric surface.

Frustum: As used in this disclosure, a frustum is a portion of a solid that lies between two parallel planes that intersect with the solid.

Perimeter: As used in this disclosure, a perimeter is one or more curved or straight lines that bounds an enclosed area on a plane or surface. The perimeter of a circle is commonly referred to as a circumference.

Plate: As used in this disclosure, a plate is a smooth, flat and rigid object that has at least one dimension that: 1) is of uniform thickness; and 2) that appears thin relative to the other dimensions of the object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An item of brushware comprising:

a handle, a toothbrush, and a tongue cleaning device;

wherein the brushware is adapted for use in oral hygiene;

wherein the brushware is the combination of the toothbrush and the tongue cleaning device mounted on the handle;

wherein the handle comprises of a shaft;

wherein the shaft is shaped in the form of the frustum of an ellipsoid;

wherein the handle is further defined with a first end and a second end;

wherein the toothbrush comprises a first head, a first shank, and a first plurality of bristles;

wherein the first plurality of bristles are connected to the first head;

wherein a first shaft connects the first head to the handle;

wherein the first head is further defined with a third end, a fourth end, a first surface and a second surface;

wherein the first shank is further defined with a fifth end and a sixth end;

wherein the tongue cleaning device further comprises a second head, a first arm, a second arm, and a second plurality of bristles;

wherein the first arm and the second arm attach the second head to the handle;

wherein the second head is further defined with a seventh end, an eighth end, a third surface, a fourth surface, an inner arc, and an outer arc;

wherein the first arm is further defined by a ninth end and a tenth end;

wherein the second arm is further defined by an eleventh end and a twelfth end;

wherein the first surface and the third surface share the same plane;

wherein the second surface and the fourth surface share the same plane;

wherein the second head has a plate structure;

wherein the perimeter of the third surface is bounded by the seventh end, the eighth end, the inner arc, and the outer arc;

wherein the perimeter of the fourth surface is bounded by the seventh end, the eighth end, the inner arc, and the outer arc;

wherein the inner arc is formed as a segment of the circumference of a first circle or ellipse;

wherein the outer arc is formed as a segment of the circumference of a second circle or ellipse;

wherein the second circle or ellipse has the same center point or points as the first circle or ellipse;

wherein the first arm is a cylindrical structure;

wherein the second arm is a cylindrical structure;

wherein the ninth end of the first arm attaches to the second end of the handle;

wherein the eleventh end of the second arm attaches to the second end of the handle;

wherein the tenth end of the first arm forms the seventh end of the second head;

wherein the twelfth end of the second arm forms the eighth end of the second head;

wherein the second plurality of bristles is a second collection of individual bristles;

wherein each of the second plurality of bristles is further defined with a fifteenth end and a sixteenth end;

wherein the fifteenth end of each of the second plurality of bristles is attached to the fourth surface of the second head such that each of the second plurality of bristles projects away from the fourth surface like a cantilever;

wherein taken together the sixteenth end of each of the second plurality of bristles forms a second plurality of bristle tips;

wherein the span of each of the second plurality of bristles is selected such that the second plurality of bristle tips forms a second brush surface.

2. The item of brushware according to claim 1 wherein the second brush surface is a planar scrubbing surface.

3. The item of brushware according to claim 2 wherein the first head is an irregularly shaped plate structure.

4. The item of brushware according to claim 3 wherein the first plurality of bristles is a first collection of individual bristles;

wherein each of the first plurality of bristles is further defined with a thirteenth end and a fourteenth end;

wherein the thirteenth end of each of the first plurality of bristles is attached to the first surface of the first head such that each of the first plurality of bristles projects away from the first surface like a cantilever.

5. The item of brushware according to claim 4 wherein when taken together, the fourteenth end of each of the first plurality of bristles forms a first plurality of bristle tips.

6. The item of brushware according to claim 5 wherein when the span of each of the first plurality of bristles is selected such that the first plurality of bristle tips forms a first brush surface;

wherein the first brush surface provides a scrubbing surface.

7. The item of brushware according to claim 6 wherein the first shank attaches the fourth end of the first head to the first end of the handle.

8. The item of brushware according to claim 7 wherein the sixth end of the first shank is formed with an elliptical or circular structure that corresponds to the elliptical or circular structure of the first end of the handle;

wherein the sixth end of the first shank is attached to the first end of the handle;

wherein the fifth end of the first shank is formed in a rectangular shape that corresponds to the rectangular structure of the irregular plate that forms the first head;

wherein the fifth end of the first shank is attached to the fourth end of the first head.

9. The item of brushware according to claim 8 wherein the structure of the first shank between the fifth end and the sixth end forms a smooth and continuous surface transition between the shape of the fifth end and the shape of the sixth end.

* * * * *